US007195494B2

(12) United States Patent
Ookura

(10) Patent No.: US 7,195,494 B2
(45) Date of Patent: Mar. 27, 2007

(54) CONNECTOR FOR ELECTRICALLY CONNECTING ELECTRONIC COMPONENTS

(75) Inventor: Kenji Ookura, Hisai (JP)

(73) Assignee: Matsushita Electric Works, Ltd.,, Osaka (JP)

( * ) Notice: Subject to any disclaimer, the term of this patent is extended or adjusted under 35 U.S.C. 154(b) by 0 days.

(21) Appl. No.: 10/558,486

(22) PCT Filed: Mar. 28, 2005

(86) PCT No.: PCT/JP2005/005750

§ 371 (c)(1),
(2), (4) Date: Nov. 28, 2005

(87) PCT Pub. No.: WO2005/096445

PCT Pub. Date: Oct. 13, 2005

(65) Prior Publication Data

US 2006/0234525 A1 Oct. 19, 2006

(30) Foreign Application Priority Data

Mar. 31, 2004 (JP) ..... 2004-107303

(51) Int. Cl.
*H01R 12/00* (2006.01)

(52) U.S. Cl. ..... 439/74

(58) Field of Classification Search ..... 439/74, 439/660

See application file for complete search history.

(56) References Cited

U.S. PATENT DOCUMENTS 5,975,916 A * 11/1999 Okura ..... 439/74
6,793,506 B1 * 9/2004 Hirata et al. ..... 439/74
6,811,411 B1 * 11/2004 Hirata et al. ..... 439/74
6,827,588 B1 * 12/2004 Huang et al. ..... 439/74

FOREIGN PATENT DOCUMENTS

| | | |
|---|---|---|
| JP | 6-011268 | 2/1994 |
| JP | 11-111873 | 4/1994 |
| JP | 11-260505 | 9/1999 |
| JP | 11-329622 | 11/1999 |
| JP | 2002-008753 | 1/2002 |
| JP | 2003-017162 | 1/2003 |
| JP | 2004-055464 | 2/2004 |
| JP | 2004-111081 | 4/2004 |

OTHER PUBLICATIONS

English Language Abstract of JP 2002-008753.

(Continued)

*Primary Examiner*—Tho D. Ta
(74) *Attorney, Agent, or Firm*—Greenblum & Bernstein, P.L.C.

(57) ABSTRACT

A socket body is reinforced by inserted or press-fitted reinforcing members inserted so that a protruding table is eliminated and a width dimension thereof is reduced. Each socket contact has a first contact portion formed in substantially U-shape for elastically deformable. A header body has concave portions on upper face of the socket body (SIC). Each header post has a second contact portion disposed along a side wall of the header body and to be contacted with a first contact portion of the socket contact, and a curved portion formed in substantially reverse U-shape toward the concave portion from a vicinity of an upper end portion of the side wall of the header body. A curvature radius of the curved portion of the header post is established to be the smallest in a scope that a free end of the first contact portion of the socket contact contacts in the second contact portion side from a peak of the curved portion, and the socket contact is rarely buckled due to scratching with the curved portion.

11 Claims, 6 Drawing Sheets

OTHER PUBLICATIONS

English Language Abstract of JP 2003-017162.
English Language Abstract of JP11-260505.
English Language Abstract of JP 6-011268.
English Language Abstract of JP 2004-055464.
English Language Abstract of JP 11-329622.
English Language Abstract of JP 6-111873.
English Language Abstract of JP 2004-111081.
U.S. Appl. No. 10/561,527 to Ookura, filed Dec. 20, 2005.
U.S. Appl. No. 10/561,526 to Ookura, filed Dec. 20, 2005.

* cited by examiner

FIG. 9A
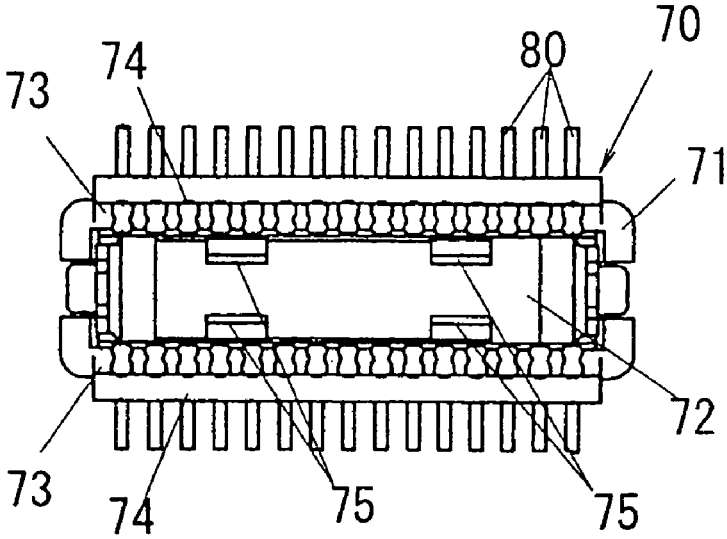
FIG. 9B
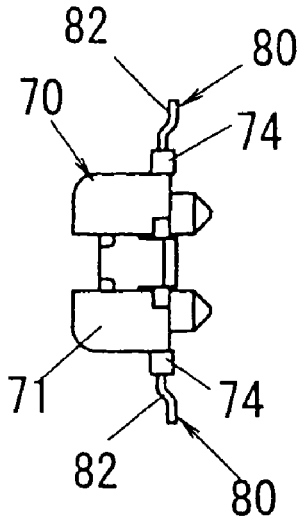
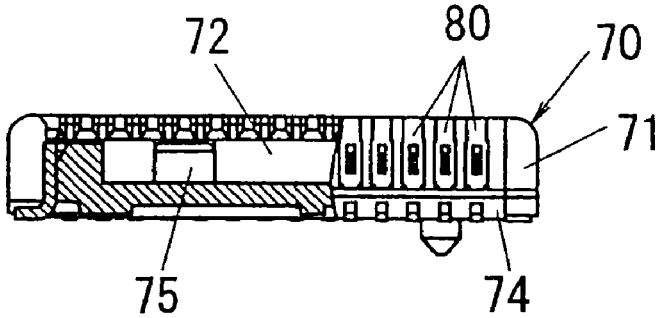
FIG. 9C
FIG. 10
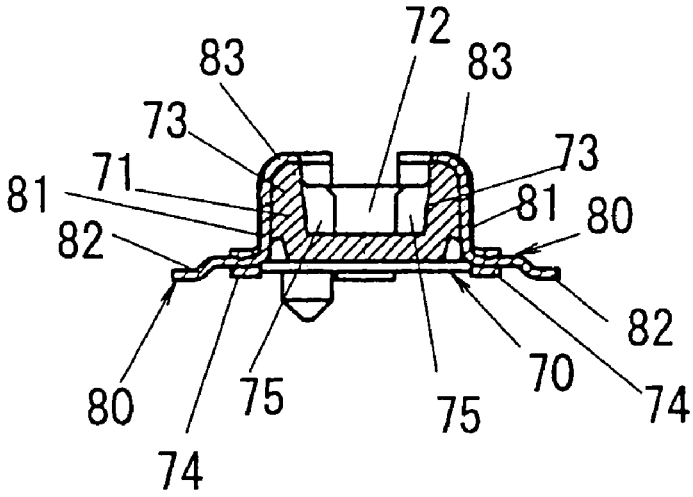

CONNECTOR FOR ELECTRICALLY CONNECTING ELECTRONIC COMPONENTS

TECHNICAL FIELD

The present invention relates to a connector comprising a socket and a header for electrically connecting between circuit boards or a circuit board and an electronic component in compact electronic equipment such as a mobile phone.

BACKGROUND ART

Conventionally, a connector which is comprised of a socket and a header is provided for electrically connecting between circuit boards, for example, an FPC and a hard board. A conventional connector mentioned in, for example, Japanese Laid-Open Patent Publication No. 2002-8753 is described with reference to FIGS. 7A to 7C, FIG. 8, FIGS. 9A to 9C and FIG. 10.

As shown in FIGS. 7A to 7C and FIG. 8, a socket 50 has a socket body 51 which is formed into a substantially flat rectangular parallelepiped shape by resin molding and a plurality of socket contacts 60 which is arranged on two lines along longitudinal direction of the socket body 51. Seen from front, a protruding table 53 of substantially rectangular parallelepiped shape is formed in a center portion of the socket body 51, and a plug groove 52 of substantially rectangular shape is formed between the protruding table 53 and each side wall 54 in longitudinal direction and each side wall 56 in widthwise direction.

The socked contact 60 is formed by bending a band metal into a predetermined shape by press working. A first contact portion 61 which is to be contacted with a header post 80 (referring to FIGS. 9A to 9C and FIG. 10) is formed at a first end portion of each socket contact 60 facing the plug groove 52. A first terminal portion 62 which is to be soldered on a conductive pattern of a circuit board is formed at a second end portion of the socket contact 60 positioned outward of the side wall 54. Each socket contact 60 is press-fitted after resin molding of the socket body 51.

On the other hand, as shown in FIGS. 9A to 9C and FIG. 10, a header 70 has a header body 71 which is formed in a shape of substantially flat rectangular parallelepiped by resin molding and a plurality of header post 80 which is arranged on two lines along longitudinal direction of the header body 71. An engaging groove 72 of substantially rectangular parallelepiped shape with which the protruding table 53 is engaged is formed at a position facing the protruding table 53 of the socket body 51. Flange portions 74 are formed on side walls 73 of the header body 71 so as to protrude substantially perpendicular to the side walls 73 from edges on rear face side (circuit board side) of the header body 71. Furthermore, engaging protrusions 75 which are to be engaged with key grooves 55 provided on the protruding table 53 of the socket 50 are formed at four positions on wall faces of the side walls 73 in side of the engaging groove 72 so that impact applied while the socket 50 and the header 70 are connected is dispersed.

The header post 80 is formed by bending a band metal into a predetermined shape by press working. A second contact portion 81 which is to be contacted with the first contact portion 61 of the socket contact 60 is formed at a position of each header post 80 along an outer surface of the side wall 73. Furthermore, a second terminal portion 82 which is to be soldered on a conductive pattern of a circuit board is formed at an end portion protruding outward from the flange portion 74. Each header post 80 is integrally fixed on the header body 71 by insert molding while the header body 71 is molded by resin.

The socket 50 and the header 70 are mounted so that the first terminal portion 62 of each socket contact 60 and the second terminal portion 82 of each header post 80 are respectively soldered on conductive patterns of circuit boards. When the header 70 is engaged with the plug groove 52 of the socket 50, the protruding table 53 of the socket 50 is relatively engaged with the engaging groove 72 of the header 70, and the first contact portion 61 of the socket contact 60 contacts the second contact portion 81 of the header post 80 with elastic deformation. As a result, a circuit board on which the socket is mounted is elastically connected with a circuit board on which the header 70 is mounted.

Generally, when the plug groove 52, with which the header body 71 is engaged, is formed on the socket body 51, mechanical strength of the socket body 51 becomes weak so that it is easily deformed. In the above-mentioned conventional connector, in order to increase the mechanical strength of the socket body 51, the protruding table 53 is provided in the inside of the plug groove 52, and the engaging groove 72 which is to be engaged with the protruding table 53 is formed on the header body 71. Therefore, the conventional connector has a problem that dimensions in widthwise directions of the socket body 51 and the header body 71 becomes larger by the dimension of the protruding table 53.

Furthermore, a curved surface portion 83 is provided in the vicinity of the front end of the header post 80 so as to contact the socket contact 60 with the header post 80 smoothly, but it is necessary to provide the engaging groove 72 on the header body 71, so that it is difficult to take a configuration that a front end of the curved surface portion 83 is hooked on the header body 71. Therefore, for example, when the header 70 is taking out and putting in for the socket 50 obliquely, the header body 71 may be deformed, and the front end of the curved surface portion 83 of the header post 80 may be raised and come off from the header body 71.

Still furthermore, as for the first contact portion 61 of the socket body 61 (SIC: 60 is correct), a distance between a pair of first contact portions 61 of the socket contacts 60 facing each other is established to be narrower than a distance between a pair of second contact portions 81 of the header post 80 which are contacted with the pair of socket contacts 60 so that contacting pressure is generated in a state of connection of the socket 50 with the header 70. While the socket 50 is connected with the header 70, a free end of each socket contact 60 contacts with the curved surface portion 83 of the header post 80, slides on the curved surface portion 83 and moves to the second contact portion 81. However, when the curvature radius of the curved surface portion 83 is made too small, the free end of the socket contact 60 may not be slid on the curved surface portion 83 smoothly, and the free end of the socket contact 60 may be scratched, so that the first contact portion 61 may be deformed due to buckling. Accordingly, there is a limit to reduce the curvature radius of (outer face of) the curved surface portion 83 of the header post 80. Since the thickness of the side walls 73 of the header body 71 is affected by the curvature radius of the curved surface portion 83 of the header post 80, there is a limit to reduce the thickness of the side walls 73, in other words, the width of the header 70.

By the way, in the connector used for a compact electronic equipment such as a mobile phone, the pitch of the socket contacts 60 and the header posts 80 is very narrow as, for example, 0.4 mm extent. In addition, a connector further downsized is demanded for further downsizing the electronic equipment. On the other hand, a dimension of the connector in longitudinal direction (arranging direction of the socket contacts 60 and the header posts 80) depends on the pitch and the number of the socket contact 60 and the header post 80. In addition, there is a limit to make the pitch of the socket contacts 60 and the header posts 80 narrower because of securing the distance for insulation. Accordingly, the downsizing of the connector can be achieved by reducing the dimension in widthwise direction thereof. Therefore, when the dimension of the connector in widthwise direction is made shorter by eliminating the protruding table 53 of the socket body 51, the mechanical strength of the socket body 51 and the header body 71 becomes a problem. It, however, can be solved by inserting or press-fitting reinforcing members into the socket body 51 and the header body 71.

DISCLOSURE OF INVENTION

A purpose of the present invention is to provide a connector with a reduced dimension in widthwise direction, by which deformation of a socket contact due to buckling can be prevented and flaking of a header post from a header body can be prevented while a socket is connected with a header.

A connector in accordance with an aspect of the present invention includes:

a header comprising a header body formed of an insulation material, and one or a plurality of header posts held on a side wall of the header body; and a socket comprising a socket body formed on an insulation material and having a plug groove with which the header is engaged, and one or a plurality of socket contacts held on a side wall of the plug groove of the socket body and contacted with the header posts when the header is engaged with the plug groove; characterized by that the socket body has a reinforcing member inserted or press-fitted therein;

the socket contact has a first contact portion disposed in an inside of the plug groove and formed substantially U-shape and elastically deformable;

the header body has a concave portion on a first face in side which is to be engaged with the plug groove of the socket body;

the header post has a second contact portion disposed along a side wall of the header body and contacted with the first contact portion of the socket contact, and a curved portion formed in a substantially reverse U-shape from a vicinity of an end in the first face side of the side wall of the header body toward the concave portion;

a curvature radius of the curved portion of the header post in at least a side of the second contact portion from a peak of the curved portion is established to be a smallest in a scope that a free end of the first contact portion of substantially U-shape of the socket contact contacts in the second contact portion side from the peak of the curved portion of the header post, and the socket contact is rarely buckled due to scratching with the curved portion.

According to such a configuration, the dimension of the connector in widthwise direction can be made smaller than that of the conventional one by eliminating the protruding table of the socket body. Furthermore, for at least the header, the curved portion of the header post is formed into the substantially reverse U-shape and reaches to the concave portion, so that that portion serves as a reinforcement of the header body. Still furthermore, the socket body is reinforced by the reinforcing member inserted or press-fitted. Thus, the mechanical strength of the socket body can be maintained, even though the protruding table of the socket body is eliminated.

Still furthermore, since the front end of the curved portion of the header post reaches to the concave portion of the header body, the front end of the header post is hooked on the header body. Thus, even when the header body is deformed, the front end of the header post is not lifted from the header body, so that the flaking of the header post from the header body can be prevented.

Still furthermore, while the header is connected to the socket, although the free end of the substantially U-shaped first contact portion of the socket contact contacts the curved portion of the header post, the free end of the first contact portion of the socket contact contacts in the side of the second contact portion from the peak of the curved portion, so that the free end of the first contact portion of the socket contact moves toward the second contact portion side with sliding on the curved portion of the header post. Then, the first contact portion of the socket contact contacts with the second contact portion of the header post, so that the socket contact and the header post are electrically connected. Since the curvature radius of the curved portion is established to be the smallest in the scope that the socket contact is not buckled by scratching with the curved portion, the free end of the first contact portion of the socket contact is rarely scratched with the curved portion, so that the deformation of the contact due to buckling can be prevented with achieving the downsizing of the connector.

BRIEF DESCRIPTION OF DRAWINGS

FIG. 9A is a front view showing the header of the conventional connector, FIG. 9B is a right side view thereof and FIG. 9C is a bottom view thereof.

FIG. 10 is a side sectional view of the header of the above conventional connector.

BEST MODE FOR CARRYING OUT THE INVENTION

Figure 1:
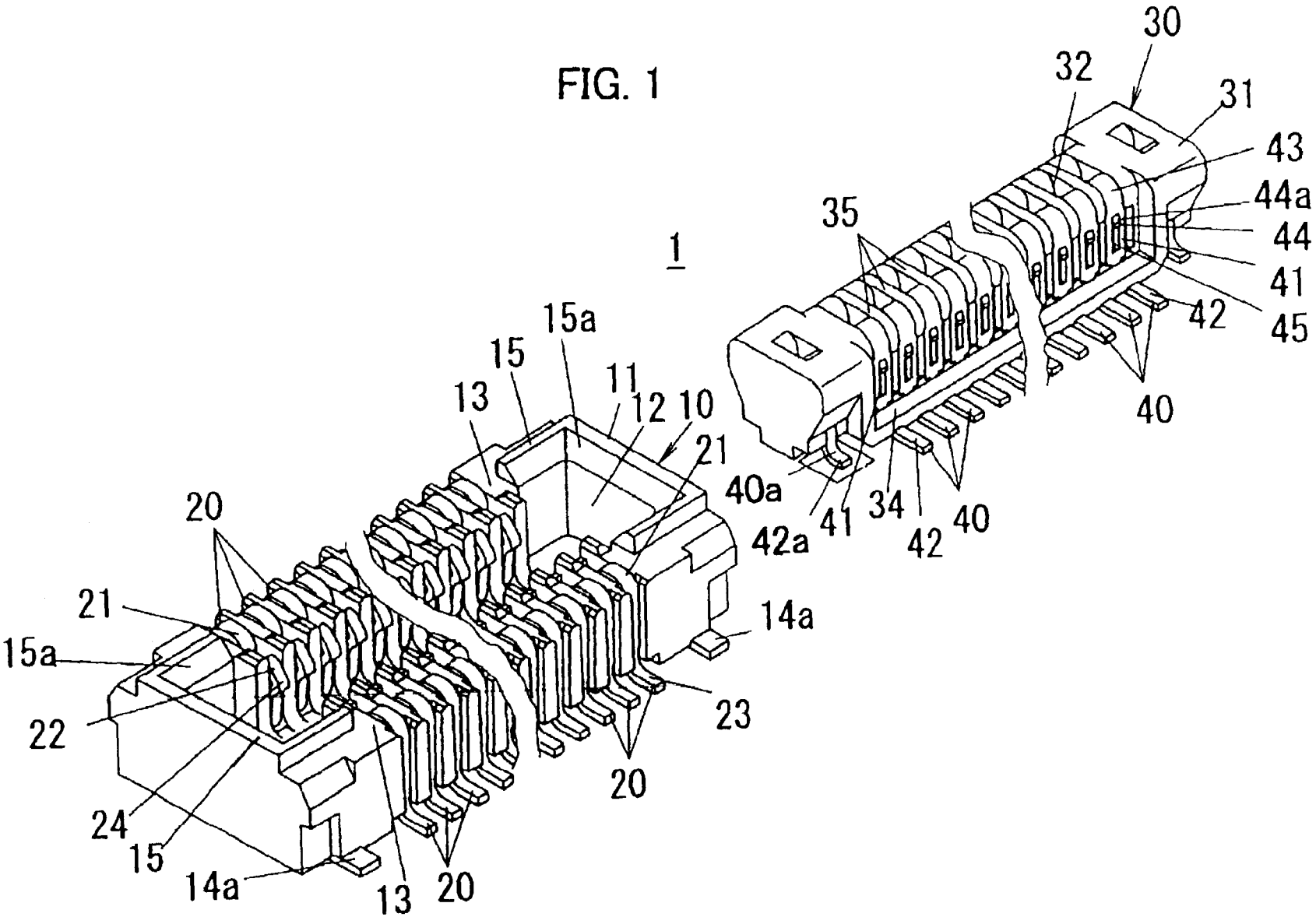
FIG. 1 is a perspective view showing a connector in accordance with an embodiment of the present invention in a state that a socket and a header thereof are divided.

A connector in accordance with an embodiment of the present invention is described in detail with reference to the drawing. A connector 1 of this embodiment is used, for example, electrically to connect between circuit boards or electronic components and the circuit board in compact electronic equipment such as a mobile phone, and it comprises a socket 10 and a header 30 as shown in FIG. 1. Especially, in a flip phone, the circuit board is divided into a plurality of pieces, and a flexible printed-circuit board (FPC) is used for hinge portion. As an example, such connector 1 is used for electrically connecting an FPC with flexibility and a hard circuit board. For example, the socket 10 is mounted on a conductive pattern formed on the hard circuit board by soldering, and the header 30 is mounted on a conductive pattern on the FPC by soldering. Then, by connecting the header 30 with the socket 10 as shown in FIG. 2, the hard circuit board and the FPC can be electrically connected.

As shown in FIG. 1 and FIGS. 3A to 3C, the socket 10 has a socket body 11 formed in a flat rectangular parallelepiped shape by resin molding, and a plurality of socket contacts arranged in two lines along side walls 13 of the socket body 11 in longitudinal direction. Seen from front, a substantially rectangular plug groove 12 is formed in center portion of the socket body 11. Guide walls 15 of substantially square cornered U-shape are provided for protruding toward the header 30 side on a plane of the socket body 11 facing the header 20 and in the vicinity of both end portions of the plug groove 12 in longitudinal direction. Slanted faces 15*a* are formed on inner peripheries (that is, the plug groove 12 side) of the guide walls 15.

Figure 2:
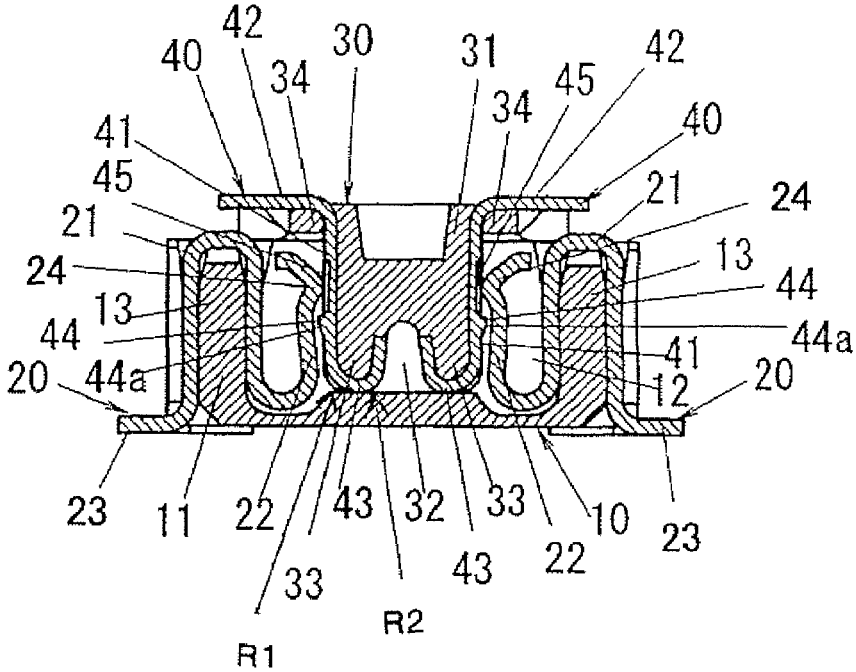
FIG. 2 is a sectional side view showing the connector in accordance with the above embodiment in a state that the socket and the header are connected.
Figure 4:
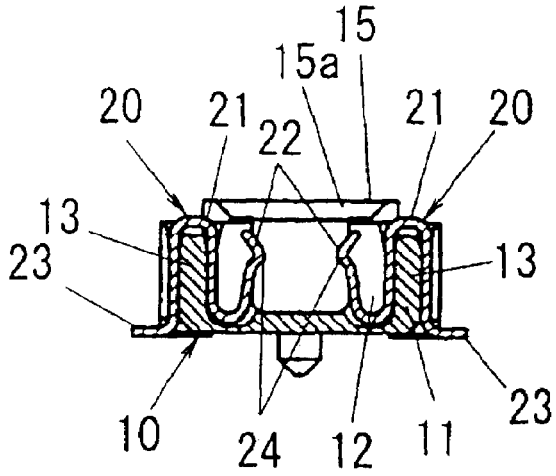
FIG. 4 is aside sectional view of the above socket.

As shown in FIG. 2 and FIG. 4, each socket contact 20 is formed by bending a band metal into a predetermined shape by press working. Each socket contact 20 is press-fitted after resin molding of the socket body 11. As mentioned above, since the pitch between each socket contact 20 is very narrow as 0.4 mm extent, it is nonsense to form the socket contacts 20 and to press-fit those into grooves formed on the side walls of the socket body 11 one by one. Therefore, slit processing is given to a side of a plate base metal so as to form a comb-shaped portion, and press working is further given to the comb-shaped portion to be a predetermined shape. Then, the socket contacts 20 which are arranged in a line on a base of the base metal are simultaneously press-fitted into the grooves formed on the side walls 13 of the socket body 11. Finally, each socket contact 20 is cut off from the base metal.

The socket contact 20 has a held portion 21 formed as substantially reverse U-shape and held on the socket body 11 in a manner to pinch an edge portion of the side wall 13 of the socket body 11, a flexure portion (first contact portion) 22 continuously formed from a portion of the held portion 21 positioned inside of the plug groove 12 and having a substantially U-shape opposite to the substantially reverse U-shape of the held portion 21, and a terminal portion 23 soldered on a conductive pattern of the circuit board and formed to protrude outward in a direction substantially perpendicular to the side walls 13 from a lower end portion (end portion on a side mounted on a circuit board) of outer face of the side wall 13 of the held portion 21. The flexure portion 22 is flexible in the direction substantially perpendicular to the side wall 13 inside of the plug groove 12. Furthermore, a contact salient 24 (free end of the first contact portion) protruding in a direction departing from the held portion 21 is formed on the flexure portion 22 by bending.

Figure 3A:
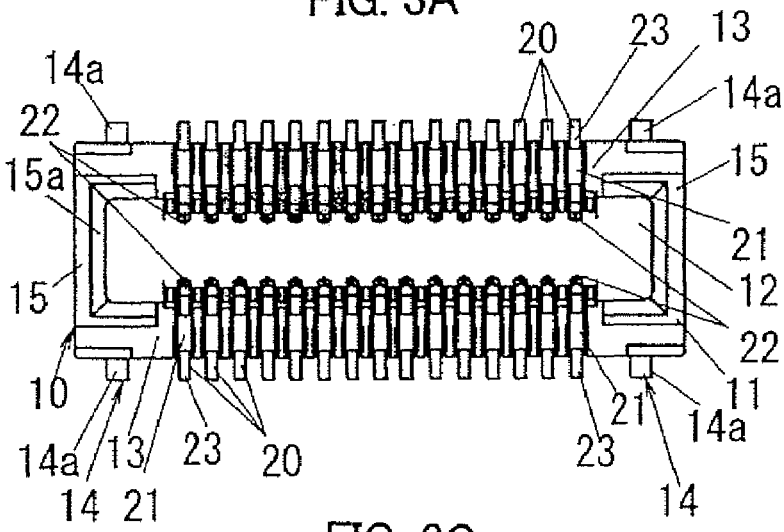
FIG. 3A is a front view showing the socket of the connector in accordance with the above embodiment.
Figure 3B:
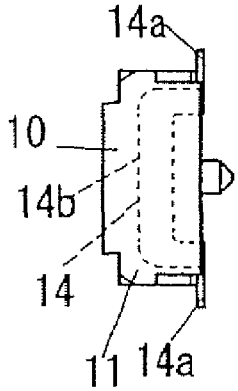
FIG. 3B is a right side view thereof and FIG. 3C is a bottom view thereof.
Figure 3C:
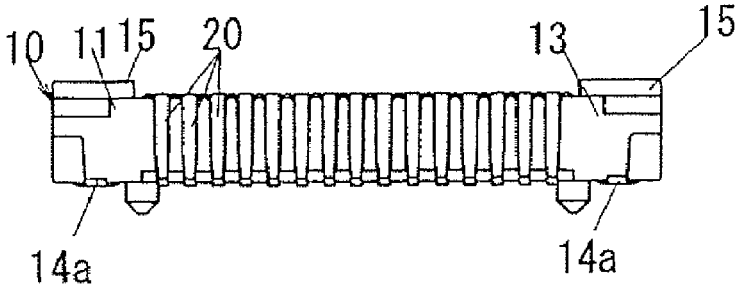

In addition, as shown in FIG. 3B, terminal reinforcing metal fittings 14 are embedded in both end portions of the socket body 11 in longitudinal direction by insert molding. The terminal reinforcing metal fitting 14 has a pair of fixed portions 14*a* respectively protruding outward from the lower ends of the side walls 13 of the socket body 11, and a coupling portion 14*b* of substantially reverse U-shape coupling between a pair of the fixed portions 14*a* and embedded in the socket body 11. The fixed portions 14*a* of the terminal reinforcing metal fitting 14 are arranged to be substantially the same height as the terminal portions 23 of the socket contacts 20. When the terminal portions 23 of the socket contacts 20 are soldered on a conductive pattern of a circuit board, the fixed portions 14*a* of the terminal reinforcing metal fitting 14 are soldered on lands of the circuit board simultaneously. Thereby, fixing strength of the socket body 11 to the circuit board can be reinforced. Furthermore, the stress applied to the socket contact 20 when the socket 10 and the header 30 are connected can be reduced by the fixed portions 14*a* of the terminal reinforcing metal fittings 14.

As shown in FIG. 1 and FIGS. 5A to 5C, the header 30 has a header body 31 formed in an elongated substantially rectangular parallelepiped shape by resin molding, and a plurality of header posts 40 arranged in two lines along both side walls 33 of the header body 31 in the longitudinal direction. In the longitudinal direction of the header 30, each cross wall 35 is formed between two adjoining header posts 40 so as to join with both side walls 33. As shown in FIG. 6, in widthwise direction of the header 30, a pair of header posts 40 are disposed for facing each other in a space enclosed by two cross walls 35, and a concave portion 32 is formed between a pair of the header posts 40, in other words, in a center portion of a first face of the socket body 11 in a side to be engaged with the plug groove 12 in the widthwise direction. Furthermore, in the vicinity of the lower ends of each side wall 33 (end portion in a second face side to be mounted on a circuit board), a flange portion 34 is formed along the longitudinal direction to protrude outward in a direction substantially perpendicular to the side wall 33.

As shown in FIG. 2 and FIG. 6, each header post 40 is formed by bending a band metal into a predetermined shape by press working. Each header post 40 is unified with the header body 31 by insert molding when the header body 31 is molded by resin. The header post 40 is formed to follow along outer wall of the side wall 33 of the header body 31, and has a second contact portion 41 to be contacted with the contact salient 24 of the socket contact 20, a terminal portion 42 formed to protrude outward in a direction substantially perpendicular to the side wall 33 from the flange portion 34 and to be soldered on a conductive pattern of a circuit board, and a curved portion 43 formed in a substantially reverse U-shape striding across the side wall 33 from the vicinity of a peak of the side wall 33 and reaching to the vicinity of a bottom of the concave portion 32. A curvature radius of outer surface side of the curved portion 43 is established to be the smallest curvature radius so that the flexure portion (first contact portion) 22 of the contact 20 is rarely buckled due to scratching with the curved portion 43.

Similar to the above-mentioned socket contact 20, since the pitch between each header post 40 is very narrow as 0.4 mm extent, it is nonsense to form the header post 40 and to insert them into a die for resin molding the header body 31 one by one. Therefore, slit processing is given to a side of a plate base metal so as to form a comb-shaped portion, and press working is further given to the comb-shaped portion to be a predetermined shape. Then, the header posts 40 which are arranged in a line on a base of the base metal are simultaneously inserted into the die for molding the header body 31. Finally, each header post 40 is cut off from the base metal after unification of the header body 31 and the header posts 40 by insert molding.

In addition, loss pins 40*a* of the header post serving as terminal reinforcing metal fittings are integrally embedded with the header body 31 by insert molding in both end portions of the header body 31 in the longitudinal direction. The loss pins 40*a* are formed on the same base metal as the header posts 40, and has substantially the same cross-sectional shape as shown in FIG. 6. However, a portion of each loss pin 40*a* corresponding to the second contact portion 41 is embedded in the both end portions of the header body 31 so that it is not exposed. Furthermore, a fixed portion 42*a* of the loss pin 40*a* corresponding to the terminal portion 42 is cut off shorter than the terminal portion 42 of the header post 40 so as to be substantially the same as the largest dimension of the header body 31 in the widthwise direction. When the terminal portions 42 of the header posts 40 are soldered on a conductive pattern of a circuit board, the fixed portions 42*a* of the loss pins 40*a* are soldered on lands of the circuit board simultaneously. Thereby, fixing strength of the header body 31 to the circuit board can be reinforced. Furthermore, the stress applied to the header post 40 when the socket 10 and the header 30 are connected can be reduced by the fixed portions 42*a* of the loss pins 40*a*.

The socket 10 and the header 30 of the connector 1 in accordance with this embodiment configured as above are respectively mounted on two circuit boards which are to be connected electrically. Specifically, the terminal portions 23 of the socket contacts 20 of the socket are soldered on a conductive pattern of one of the circuit boards, for example, a hard circuit board, and the terminal portions 42 of the header posts 40 of the header 30 are soldered on a conductive pattern of the other circuit board, for example, an FPC. When the header 30 is engaged with the plug groove 12 of the socket 10, the socket contacts 20 of the socket 10 are electrically connected to the header posts 40 of the header 30. Simultaneously, the conductive pattern of the hard circuit board is electrically connected to the conductive pattern of the FPC via the socket contacts 20 and the header posts 40.

Hereupon, when the socket 10 and the header 30 are connected, the contact salient (free end of the first contact portion) 24 of the socket contact 20 contacts on outer surface side of the curved portion 43 of substantially reverse U-shape provided on the front end portion of the header post 40. The curvature radius of the curved portion 43 of the header post 40, however, is established to be the smallest curvature radius that at least the socket contact 20 is rarely buckled due to scratching with the curved portion 43. Thus it is possible to reduce the dimension of the header body 31 in the widthwise direction and to downsize the connector 1 with preventing the buckling of the socket contact 20. Furthermore, the curved portion 43 of substantially reverse U-shape is inserted in the header body 31 so that it strides across the side wall 33 on each side of the concave portion 32, and an end of the curved portion 43 is hooked on the bottom face of the concave portion 32. Thus, even though the header body 31 is deformed while the socket 10 and the header 30 are connected, the header post 40 is rarely flaked due to rising up from the surface of the header body 31.

In addition, when the header 30 is engaged with the plug groove 12 of the socket 10, the slanted faces 15*a* of the guide walls 15 provided on periphery portions of the plug groove 12 serve as guide of the header 30. Therefore, even though the relative position of the header 30 with respect to the socket 10 is discrepant in some measure, the header 30 can easily be engaged with the plug groove 12.

Figure 5A:
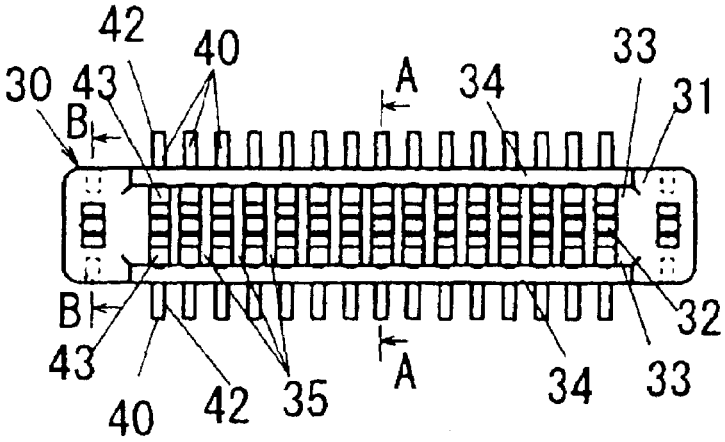
FIG. 5A is a front view showing the header of the connector in accordance with the above embodiment.
Figure 5B:
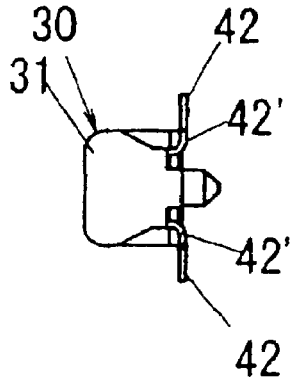
FIG. 5B is a right side view thereof and FIG. 5C is a bottom view thereof.
Figure 5C:
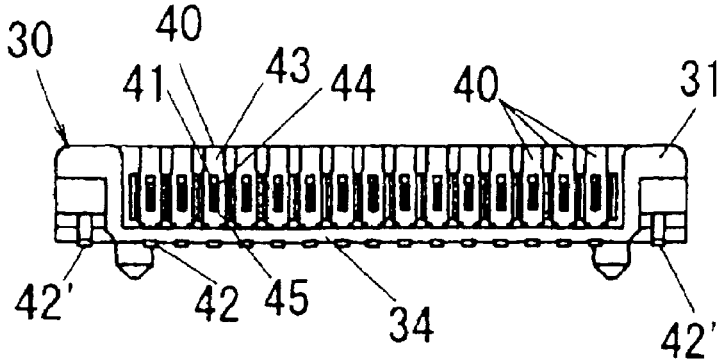
Figure 6A:
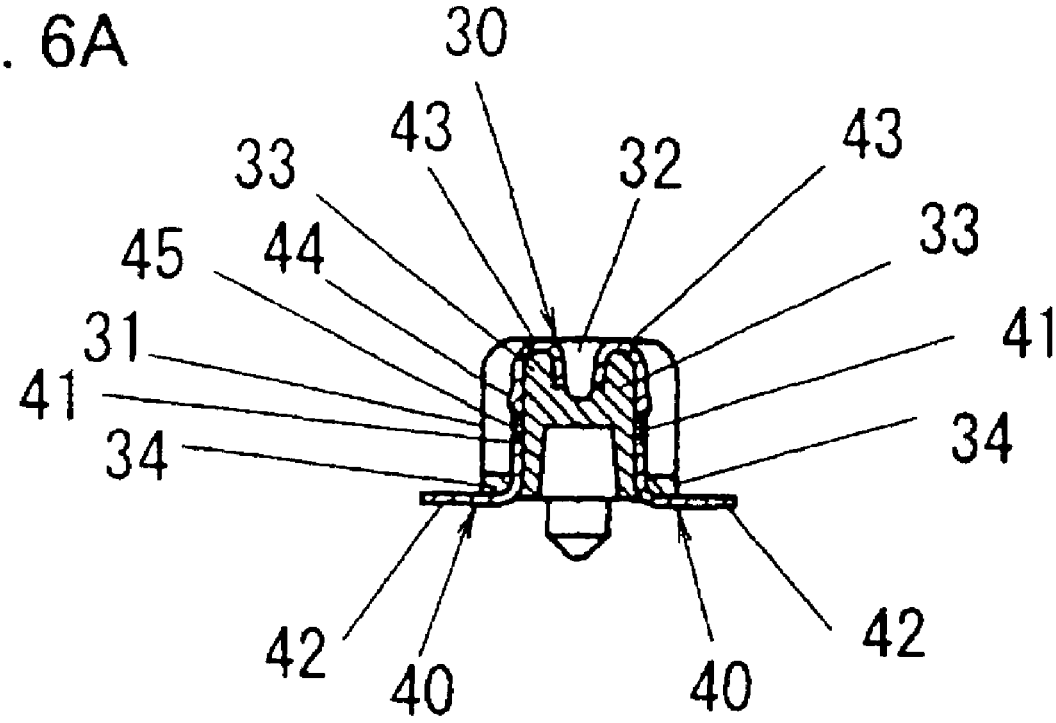
FIG. 6A is A—A sectional view in FIG. 5A.
Figure 6B:
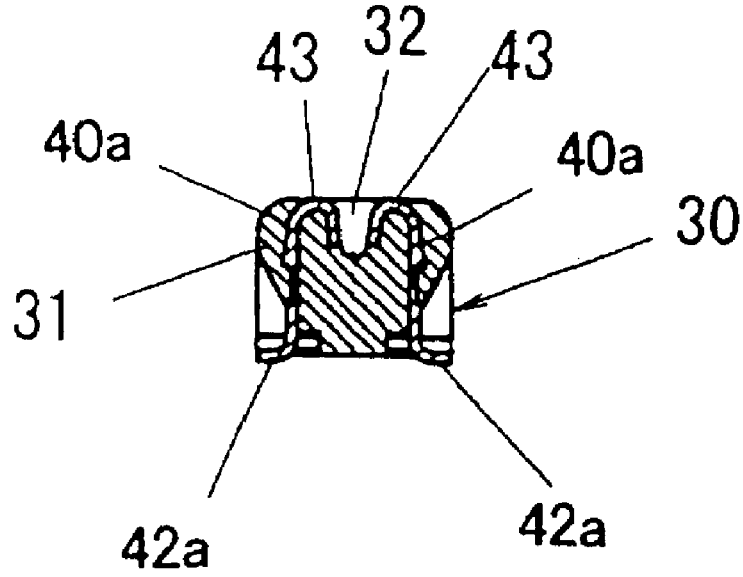
FIG. 6B is B—B sectional view in FIG. 5A.
Figure 7A:
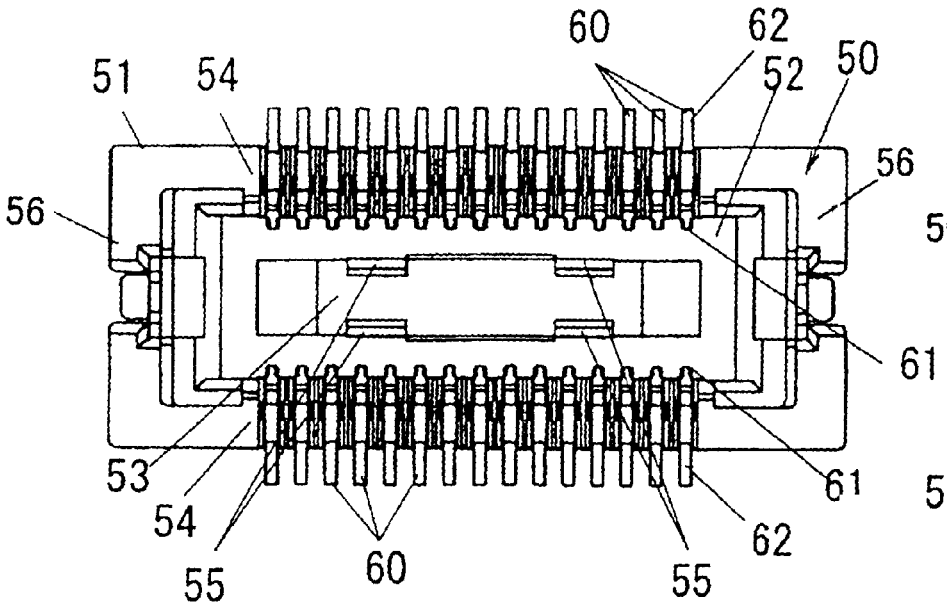
FIG. 7A is a front view showing a socket of a conventional connector.
Figure 7B:
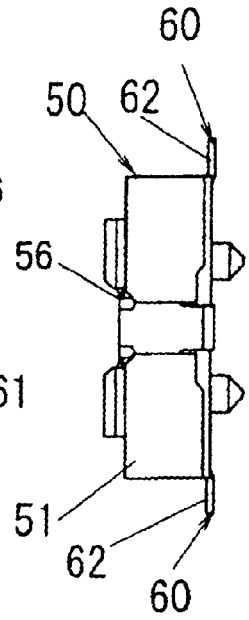
FIG. 7B is a right side view thereof and FIG. 7C is a bottom view thereof.
Figure 7C:
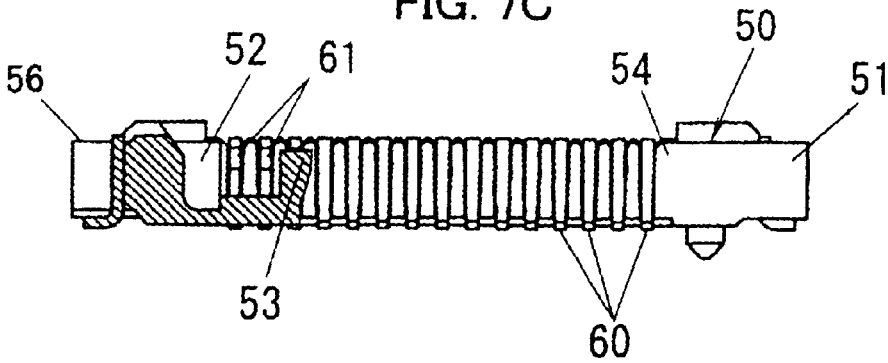
Figure 8:
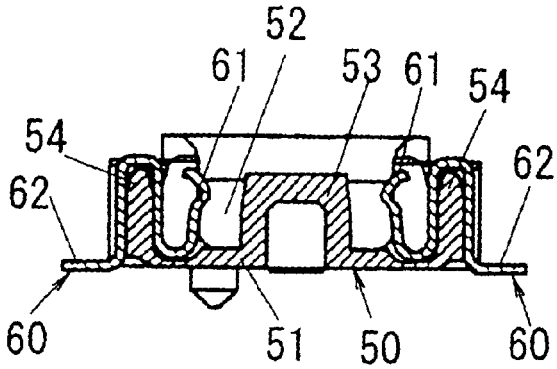
FIG. 8 is a side sectional view of the socket of the above conventional connector.

Furthermore, as shown in FIG. 1, FIG. 2, FIG. 5C and FIG. 6A, a protrusion 44 and a concavity 45 are provided at positions of the second contact portion 41 of the header post 40 where the contact salient 24 of the socket contact 20 slides. Specifically, as shown in FIG. 1 and FIG. 5C, the protrusion 44 is formed at a position a little upper (opposite side to the protrusion of the terminal portion 42) than the center of the header post 40 in heightwise direction. A slanted face 44*a* is formed on an outer face of the protrusion 44 so that a dimension of protrusion at a portion nearer to the terminal portion 42 becomes larger. The concavity 45 is a channel shape elongating along the heightwise direction of the header post 40, and has two slanted faces depth of which becomes deeper for approaching to the center in the widthwise direction so that the section in the widthwise direction of the header post 40, that is, the direction crossing at right angle with the above heightwise direction becomes substantially V-shape. A width dimension of the concavity 45 in the widthwise direction of the header post 40 is formed to be wider than a width dimension of the protrusion 44, and smaller than a width dimension of the contact salient 24. In addition, the dimensions and position of the concavity 45 in the heightwise direction of the header post 40 are established in a scope that the contact salient 24 of the socket contact 20 slides on the second contact portion 41.

According to such configuration, under a state that the header 30 is fully inserted into the plug groove 12 of the socket 10 shown in FIG. 2, the contact salient 24 contacts both side portion of the concavity 45, and the protrusion 44 is positioned in the bottom face side of the plug groove 12 from the contact salient 24. Furthermore, in a process for inserting the header 30 into the plug groove 12 of the socket 10, the contact salient 24 elastically contacts both sides of the concavity 45 in the second contact portion 41 of the header post 40. Still furthermore, an area among the contact salient 24 which contacts the protrusion 44 is not overlapped to an area contacting the both sides of the concavity 45. Thus, even though extraneous substance is adhered on the contact salient 24 of the socket contact 20 or the second contact portion 41 of the header post 40 before the socket 10 and the header 30 are connected, the extraneous substance can be dropped into the concavity 45 in the process that the contact salient 24 slides on the surface of the second contact portion 41. Accordingly, in comparison with the case that no concavity 45 is provided on the second contact portion 41 of the header post 40, the possibility that the extraneous substance is wedged between the contact salient 24 and the second contact portion 41 becomes lower. In other words, by providing the protrusion 44 and the concavity 45 on the second contact portion 41 of the header post 40, poor contacting between the socket contact 20 and the header post 40 due to extraneous substance can be prevented. Furthermore, the contact salient 24 contacts at two points on both sides of the concavity 45, so that contact reliability of the socket contact 20 and the header post 40 can be increased. Still furthermore, the concavity 45 is provided on the second contact portion 41 of the header post 40 in the scope of sliding of the contact salient 24, so that the extraneous substance adhered on the contact salient 24 can be dropped in the concavity 45 surely, in comparison with the case that the concavity 45 is provided at a portion out of the scope of sliding of the contact salient 24.

Furthermore, when power is applied to the header 30 in a direction pulled out from the plug groove 12 of the socket 10, the contact salient 24 of the socket contact 20 contacts the protrusion 44 of the header post 40, so that it receives resistance force from the protrusion 44. Therefore, there is an advantageous merit that the header 30 is hardly pulled out from the plug groove 12 of the socket 10. By the way, when the header 30 is inserted into the plug groove 12 of the socket 10, the contact salient 24 of the socket contact 20 contacts the protrusion 44 of the header post 40. However, since the slanted face 44*a* is formed on the protrusion 44 in a manner so that the protruding dimension becomes larger at a position nearer to the terminal portion 42, the resistance when the header 30 is inserted into the plug groove 12 becomes smaller than the resistance when the header 30 is pulled out from the plug groove 12. Furthermore, since the position and shape of the concavity 45 is established in a manner so that the scope contacting with the protrusion 44 is not overlapped with the scope contacting with both sides of the concavity 45 on the contact salient 24, the extraneous substance pushed by the contact salient 24 is dropped into the concavity 45 while the contact salient 24 slides on the surface of the protrusion 44 and rarely wedged between the contact salient 24 and the second contact portion 41.

In this embodiment, the contact salient 24 of the socket contact 20 is elastically contacted with both sides of the concavity 45 on the second contact portion 41 of the header post 40, and the extraneous substance is dropped into the concavity 45 in the process that the contact salient 24 slides on the surface of the second contact portion 41, so that the possibility that the extraneous substance is wedged between the contact salient 24 and the second contact portion 41 is reduced, and the contact reliability is increased. The shapes and the contact condition of the contact salient 24 of the socket contact 20 and the second contact portion 41 of the header post 40, however, are not limited to the description of the above-mentioned embodiment. For example, it is possible that the face of the contact salient 24 of the socket contact 20 which contacts with the second contact portion 41 of the header post 40 is formed in a shape (for example, curved surface shape) that a center portion in the widthwise direction thereof is protruded toward the second contact portion 41 of the header post 40 than both side portion. In such case, the center portion of the contact salient 24 of the socket contact 20 in the widthwise direction proceeds into the concavity 45, and contacts at two points with two slanted faces in the concavity 45 or edges of the opening of the concavity 45. Although the shape of the socket contact 20 becomes complex in comparison with the case that the contact salient 24 of the socket contact 20 and the second contact portion 41 of the header post 40 are contacted with each other on flat surfaces, the contacting area of the contact salient 24 and the second contact portion 41 becomes smaller so that the contact pressure increases. As a result, the extraneous substance can easily be discharged between the contact salient 24 and the second contact portion 41, so that the contact reliability of the socket contact 20 and the header post 40 is increased.

Furthermore, it is sufficient that the curvature radius of the curved portion 43 of the header post 40 in at least the side of the second contact portion 41 from the peak of the curved portion 43 is established to be the smallest in the scope that the contact salient (free end) 24 of the flexure portion (first contact portion) 22 of substantially U-shape of the socket contact 20 contacts with the side of the second contact portion 41 from the peak of the curved portion 43 of the header post 40, and the socket contact 20 is not buckled due to scratching with the curved portion 43, while the header 30 is engaged with the plug groove 12 of the socket body 11. For example, by establishing the curvature radius $R_2$ of a portion of the curved portion 43 of the header post 40 opposite to the second contact portion 41 from the peak of the curved portion 43 smaller than the curvature radius of a portion $R_1$ in the side of the second contact portion 41 from the peak of the curved portion 43, the width dimension of the header 30, in other words, the width dimension of the connector 1 can be made much smaller.

This application is based on Japanese patent application 2004-107303 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

The invention claimed is:

1. A connector comprising:

a header having a header body and at least one header post held on a side wall of said header body, wherein said header body has a header contact portion; and a socket having a socket body and at least one socket contact, wherein said socket body has a reinforcer therein and said at least one socket contact has an elastically deformable generally U-shaped socket contact portion disposed inside of a plug groove of said socket body, and wherein said plug groove is configured to engage said header such that said at least one socket contact, which is held on a side wall of said plug groove, contacts said at least one header post when said header engages said plug groove;

wherein said header body has a concave portion provided on a first face side which is configured to communicate with said plug groove of said socket body when said socket engages said header, and wherein said at least one header post of said header body has a terminal end which protrudes outward in a direction generally perpendicular to said side wall of said headed body; and wherein a curved portion is provided on the concave portion of the header body, said curved portion comprising a first curved segment extending generally from a center of the U-shaped curved portion along an outside surface of said header body, and a second curved segment extending generally from said center of said U-shaped curved portion along an inside surface of said header body, wherein a first curvature radius of said first curved segment is larger than a second curvature radius of said second curved segment, wherein an arcuate segment of said curved portion surrounds an upper surface of said header body and contacts a bottom facing surface of said plug groove when said header engages said socket.

2. The connector according to claim 1, wherein at least one of said header and said socket comprise an insulating material.

3. The connector according to claim 1, wherein said at least one socket contact is a plurality of socket contacts, and wherein said at least one headed post is a plurality of header post.

4. The connector according to claim 1, wherein said first curvature radius is sized such that buckling caused by engagement between said socket contact and said curved portion is prevented.

5. The connector according to claim 1, wherein a protrusion and a concavity are provided in series on a contact portion of said at least one header post which contacts said at least one socket contact, and extends in a heightwise direction of said header.

6. The connector according to claim 5, wherein said header has a first face proximate said curved portion and a second face proximate said terminal end, wherein said protrusion is formed at a position closer to said first face than to said second face in the heightwise direction of the header post.

7. The connector according to claim 5, wherein a slanted face is formed on an outer face of said protrusion such that a dimension of said protrusion at a portion nearer to said second face becomes larger.

8. The connector according to claim 5, wherein said concavity has an elongated channel shape extending along said heightwise direction of the header post.

9. The connector according to claim 5, wherein the concavity has two slanted faces forming a generally V-shaped cross-section in a widthwise direction of the header post.

10. The connector according to claim 5, wherein a width dimension of said concavity in said widthwise direction of said header post is formed to be larger than a width dimension of said protrusion and smaller than a width direction of a first contact portion of said at least one socket contact.

11. The connector according to claim 5, wherein dimensions and a position of said concavity in the heightwise direction of said header post is sized such that said socket contact portion of said socket slidably contacts said header contact portion of said header.

* * * * *